United States Patent [19]

Poe

[11] 3,936,898

[45] Feb. 10, 1976

[54] PORTABLE RAMP FOR WHEEL CHAIRS

[76] Inventor: Alice Poe, 10330 Outlook Drive, Leawood, Kans. 66207

[22] Filed: May 5, 1975

[21] Appl. No.: 574,303

[52] U.S. Cl. ..... 14/72 R
[51] Int. Cl.[2] ..... E01D 15/12
[58] Field of Search ..... 14/72, 71

[56] References Cited

UNITED STATES PATENTS

| | | | |
|---|---|---|---|
| 2,141,529 | 12/1938 | Gravelle | 14/72 |
| 2,624,058 | 1/1953 | Kudrna | 14/72 |
| 2,759,207 | 8/1956 | Pennington | 14/72 |
| 3,030,645 | 4/1962 | Shaw | 14/72 |
| 3,069,709 | 12/1962 | Law | 14/72 |
| 3,153,798 | 10/1964 | Drevitson | 14/72 |
| 3,711,882 | 1/1973 | Iller | 14/72 |
| 3,818,528 | 6/1974 | Petersen | 14/72 |

*Primary Examiner*—Nile C. Byers

[57] ABSTRACT

This invention consists primarily of a pair of hinged together plates of rectangular configuration which are secured fixedly to tubular members, each of the tubular members having leg members on one end of the ramp so as to support it in an inclined position, the unit includes a carrying handle, a latch strap and hook means for suspending the device from a wheel chair when it is not in use.

3 Claims, 6 Drawing Figures

PORTABLE RAMP FOR WHEEL CHAIRS

This invention relates to platforms, more particularly to a portable ramp.

It is therefore the principal object of this invention to provide a portable ramp which will be lightweight and rugged in construction and will be suitably adaptable for wheelchairs.

Another object of this invention is to provide a portable ramp for wheelchairs which will be used to transfer a wheelchair with a person in it, from one level to another, such as from the street level to the curb and vice versa.

Another object of this invention is to provide a portable ramp for a wheel chair which will be foldable into a compact assembly that may be hung from the rear of the wheelchair for transporting, and the device includes a handle grip in order that it may be readily carried by hand.

A further object of this invention is to provide a portable ramp or a wheelchair which will have a pivotable latch strap which will hold the two halfs of the device in folded position when it is hung from the rear of a wheelchair or is being carried by hand.

Other objects of the invention are to provide a portable ramp for a wheelchair which is simple in design, inexpensive to manufacture, rugged in construction, easy to use and efficient in operation.

These and other objects will be readily evident upon a study of the following specification and the accompanying drawings, wherein.

Figure 3:
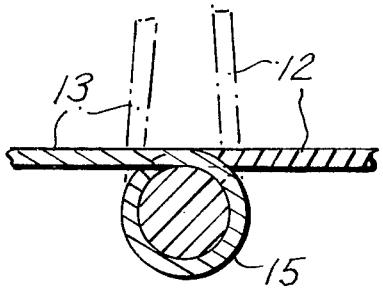
FIG. 3 is an enlarged cross-sectional view taken along the line 3—3 of FIG. 2 shows the folded position in phantom lines.
Figure 1:
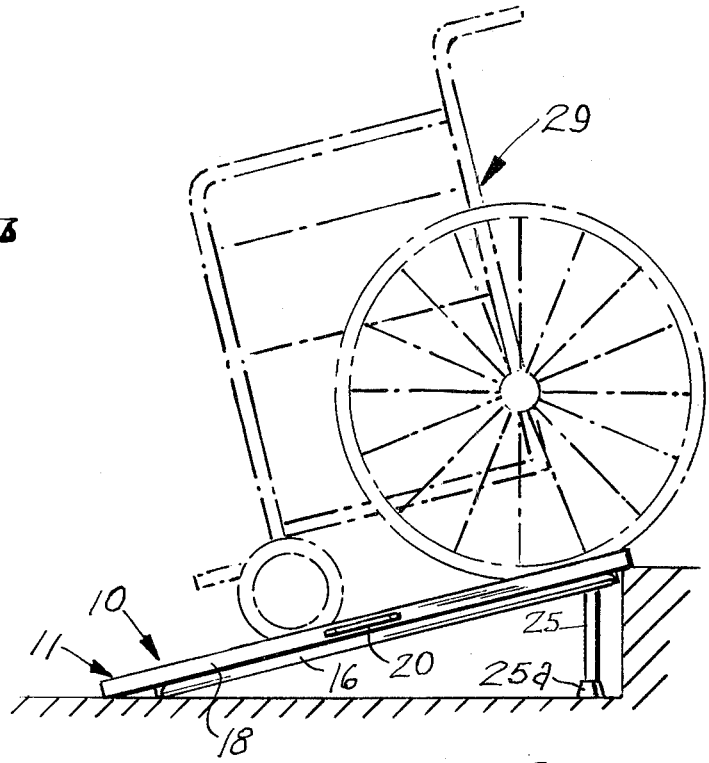
FIG. 1 is a side view of the present invention showing a wheelchair in phantom lines.
Figure 2:
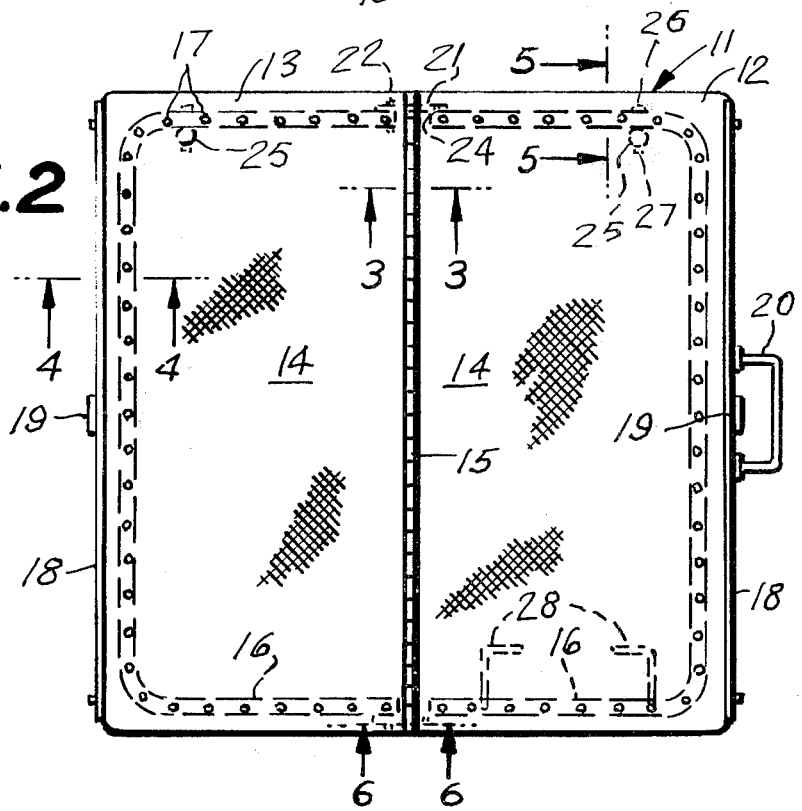
FIG. 2 is an enlarged top plan view of the invention.
Figure 4:
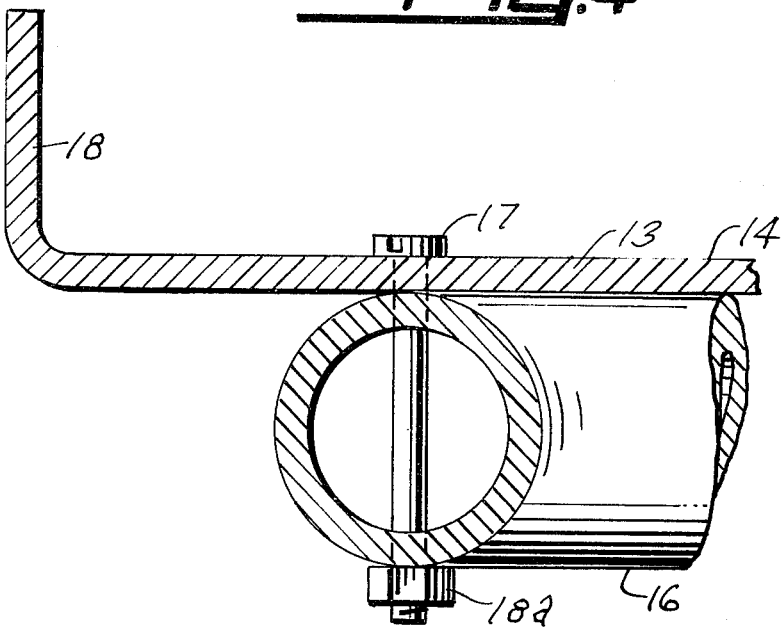
FIG. 4 is an enlarged cross-sectional view taken along the line 4—4 of FIG. 2.
Figure 5:
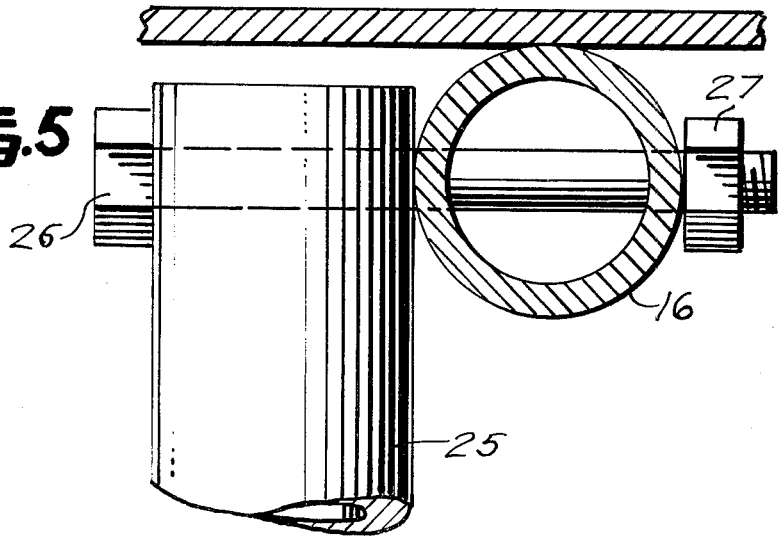
FIG. 5 is an enlarged cross-sectional view taken along the lines 5—5 of FIG. 2 and shows one of the legs mounted to the spring portion of the invention.
Figure 6:
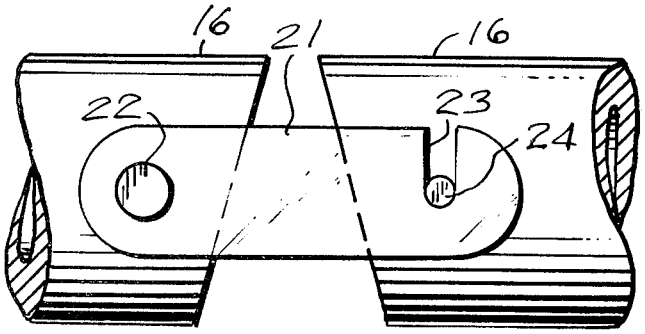
FIG. 6 is an enlarged cross-sectional view taken along the line 6—6 of FIG. 2.

According to this invention, a portable ramp 10 is shown to include a pair of rectangular configurated plates 12 and 13 having a narrowed surface 14 so as to prevent slippage when wheels are in contact therewith. Plates 12 and 13 are secured fixedly at one side edge to an elongated hinge 15 and the outer side edges of the structure includes an upwardly extending flange 18 so as to prevent the wheels of a chair from running off of ramp 10. Secured fixedly to the flanges 18 are a snap latch 19 which when ramp 10 is folded will render them secure together. Secured to the bottom of each of the plates 12 and 13, are a pair, one each, of U-shaped tubular members 16 which are fixedly secured thereto by means of suitable fasteners 17 receiving nut fasteners 18*a*. A handle grip 20 is secured fixedly in a suitable manner to one of the flanges 18 so as to enable a person to carry ramp 10 if desired. A latch strap 21 is pivotably secured to one of the tubular members 16, by means of a pin 22 and the latch strap 21 is provided with an opening 23 which will slidably engage with an extending pin 24 secured fixedly to the opposite tubular member 16, the strap 21 serving to hold the ramp in folded position when it is hung. A tubular leg 25 having a rubber foot 25*a* is secured to one side of each of the frames tubular members 16 by bolt fastener 26 receiving a nut fastener 27, the legs 25 serving as a supporting means for end of ramp 10. A pair of hood members 28 are secured rotatably to one side of one of the tubular members 16 and hook 28 may be rotated throughout 360° in order that they may be turned upward so as to depend ramp 10 from the rear of wheelchair 29.

It shall be noted that the surface 14 of plates 12 and 13 are provided with a serrated surface 14 or may be provided with a skid resistant material so as to minimize slipping of either the wheelchair 29 or the person propelling the wheelchair 29.

It shall further be recognized that all of the components fastened to the tubing 16 may be secured by any suitable fastening means other than bolt and nut fasteners.

What I claim is:

1. A portable ramp for wheelchairs, comprising a pair of hinged together and rectangular configurated plates with flange means so as to prevent said wheelchair from rolling off the side edges of said ramp, a pair of U-shaped tubular members secured to one side of said plates, a pair of spaced apart leg members secured one each to said tubular members, a pivotable latch strap member secured to one of said tubular members, handle grip means secured to one of said flanges and snap latch means secured one portion each to said flange members, a pair of rotatable hook members secured to said platform providing depending means for said portable ramp from the rear of said wheelchair.

2. The combination according to claim 1, wherein said plates are secured fixedly to one side of an elongated hinge extending from one end of said ramp to the other, said plates being foldable towards each other and said latch snap is secured pivotably by pin means secured fixedly to one of said tubular members and an extending and fixedly secured pin member extending from the opposite tubular member freely and slidably receives the slot portion at the end of said strap.

3. The combination according to claim 2, wherein said leg members are spaced apart and provided with rubber feet means for a ground surface and elevating one end of said ramp so as to incline said ramp and said flanges extend upwards from the sides of said a ramp, one of said flanges having secured fixedly thereto said handle grip and said hook means are a pair of rotatably secured and spaced apart to one of said tubular members is formed spring means for said ramp.

* * * * *